US005996709A

United States Patent [19]

Norris

[11] Patent Number: 5,996,709

[45] Date of Patent: Dec. 7, 1999

[54] PROJECTILE ASSISTED DRILL FOR SEISMIC OPERATIONS

[75] Inventor: Michael W. Norris, Cypress, Tex.

[73] Assignee: Western Atlas International, Inc., Houston, Tex.

[21] Appl. No.: 09/035,348

[22] Filed: Mar. 5, 1998

[51] Int. Cl.[6] ..... E21B 7/18

[52] U.S. Cl. ..... 175/4.5; 175/2; 299/13

[58] Field of Search ..... 299/13; 175/3.5, 175/2, 3, 4.5, 4.51, 4.52, 4.53, 4.54, 4.55, 4.56

[56] References Cited

U.S. PATENT DOCUMENTS

| | | | |
|---|---|---|---|
| 3,576,219 | 4/1971 | Angona | 175/4.5 |
| 3,633,686 | 1/1972 | Bennett | 175/4.5 |
| 4,088,368 | 5/1978 | Lavon et al. | 299/13 |
| 4,582,147 | 4/1986 | Dardick | 175/4.5 X |
| 5,148,877 | 9/1992 | MacGregor | 175/79 |
| 5,829,538 | 11/1998 | Wesson et al. | 175/4.6 |

*Primary Examiner*—David Bagnell
*Assistant Examiner*—Sunil Singh
*Attorney, Agent, or Firm*—Alan J. Atkinson

[57] ABSTRACT

A portable system for drilling geophysical shot holes in mixed geologic conditions. The system includes a drill for creating a shot hole in unconsolidated soil and for maintaining gauge in mixed geologic conditions. An explosive projectile for contacting hard rock is directed by a shot barrel, and a compressed air device removes residue from the shot hole. A controller can selectively discharge explosive projectiles when the drill bit encounters hard rock, and can cease the discharge of explosive projectiles when the drill bit encounters unconsolidated soil below hard rock. The system is particularly useful in preparing a slender shot hole in remote conditions restricting the mobility of drilling equipment, and in mixed geologic conditions comprising unconsolidated soils and hard rock aggregates or base rock.

20 Claims, 2 Drawing Sheets

PROJECTILE ASSISTED DRILL FOR SEISMIC OPERATIONS

BACKGROUND OF THE INVENTION

The present invention relates to the field of drilling shot holes for seismic geophysical exploration in remote areas. More particularly, the present invention relates to a portable drill for creating shot holes through unconsolidated and hard rock geologic formations.

Certain geophysical seismic operations use explosive charges to generate shock waves for penetrating subsurface geologic formations. The shock waves are reflected from subsurface geologic structures and interfaces, and the reflected signals are detected with receivers or geophones located at the surface. In land-based geophysical seismic operations, shallow shot holes from five to several hundred feet are drilled into the upper geologic formations. Explosive charges are positioned within the shot holes, and the explosive charges are detonated to generate the shock waves.

Seismic operations are frequently performed in remote areas. The topography, ground cover, and inaccessibility of remote areas significantly restricts seismic equipment use, and these limitations are particularly significant in the creation of shot holes. Helicopters can position shot hole drilling equipment in remote locations, but conventional shot hole drilling equipment is significantly affected by the local soil conditions. Such soil conditions can include clays, shales, peat bogs, alluvial soils, granite, and other materials and combinations of materials.

A conventional rotary or reciprocating drill can generate a shot hole in unconsolidated soils such as topsoil and clay layers. Additionally, hard rock drills have been developed to generate shot holes in hard rock strata. However, conventional drilling equipment is slow and has difficulties in mixed geologic conditions where unconsolidated soil material overlays hard rock. In mixed geologic conditions, rotary and reciprocating drills can penetrate the unconsolidated soils but cannot penetrate the underlying hard rock at acceptable drilling rates. Hard rock drills are ineffective in unconsolidated soils because the drill mechanism is fouled by clay materials. Furthermore, hard rock drills using explosives are ineffective in unconsolidated soils because the explosives generate craters in the unconsolidated soils and create an unstable shot hole profile.

Alluvial soils present a different obstacle to shot hole drilling operations because alluvial soils often include rounded stones and boulders within a clay or other unconsolidated soil matrix. Even if a hard rock drill could adequately penetrate the unconsolidated soils, contact with an embedded hard stone can deflect the hard rock drill away from the desired path. This problem is particularly significant in shot hole drilling because the drill stem is relatively slender and is susceptible to deflection. If the shot hole is deflected off course by a hard stone in an alluvial soil, the accuracy of the explosive charge location will be affected and source position error can be introduced into the seismic processing calculations.

The elimination of source position error is particularly important in three dimensional seismic operations. A slight deviation of the shot hole due to deflection of the drilling mechanism will move the bottom hole shot location by several meters, depending on the offset and shot hole depth. This deviation can be significant in seismic data processing. Accordingly, a need exists for an improved shot hole drilling system capable of portable deployment and operation in complex, mixed geologic conditions with acceptable drilling rates.

SUMMARY OF THE INVENTION

The invention comprises a system for drilling a shot hole in mixed geologic conditions of unconsolidated soils and hard rock. The system includes a portable base, a drill for creating a shot hole in the unconsolidated soil and for maintaining shot hole gauge through mixed geologic conditions, an explosive projectile for impacting hard rock in the shot hole path to generate shot hole residue, a shot barrel engaged with said drill for directing said explosive projectile against the hard rock, and a means for removing said shot hole residue from the shot hole.

In different embodiments of the invention, the shot barrel can be moved to select the contact of the explosive projectile against the hard rock, and multiple shot barrels can be incorporated to define the shot pattern. The explosive projectile can include a secondary explosive and a case formed with ceramic material. Compressed air can accelerate explosive projectiles against the hard rock within the shot hole path. A controller can selectively control the discharge of explosive projectiles and the sequence of compressed air between explosive projectiles.

DESCRIPTION OF THE PREFERRED EMBODIMENTS

The invention uniquely provides a portable system for creating a shot hole in mixed geologic conditions including unconsolidated soils and hard rock. The invention eliminates the need for multiple, independent drilling systems and is capable of drilling a shot hole in different soil and rock conditions.

Figure 1:
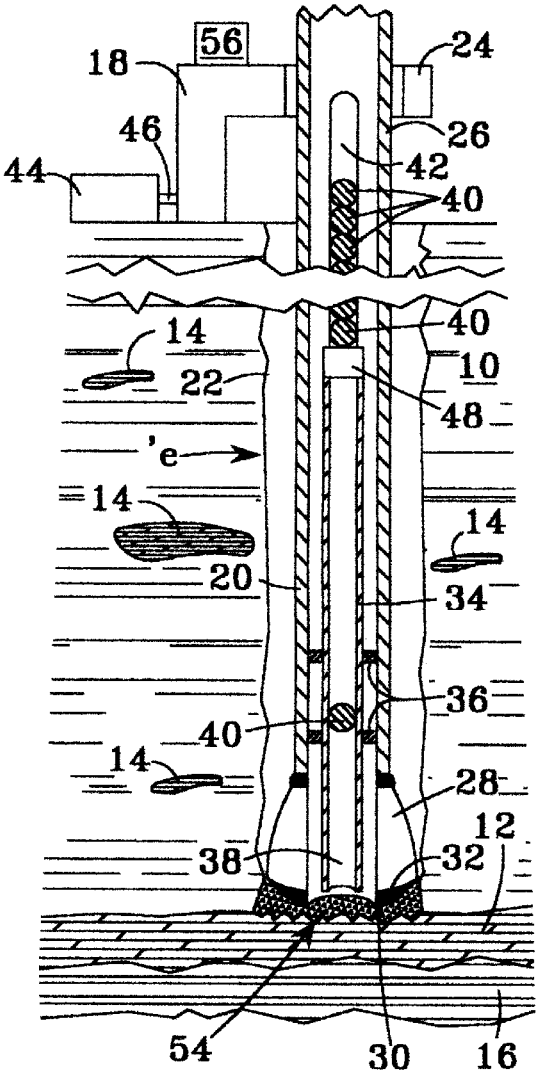
FIG. 1 illustrates a partial sectional view for one inventive embodiment of a shot barrel positioned within a shot hole.

FIG. 1 illustrates a mixed geologic condition wherein unconsolidated soil 10 overlays hard rock 12. Unconsolidated soil 10 includes hard rock stones identified as 14, and unconsolidated clay layer 16 underlays hard rock 12. FIG. 1 is representative of numerous local soil conditions, and "unconsolidated soil" is used herein as meaning any material drillable with conventional rotary or reciprocating drill bits. Unconsolidated soil can include peat, sand, gravel and other aggregates, topsoil, alluvial mixtures, clay, loose shales, and related materials. The term "hard rock" as used herein can include any form of sedimentary, igneous or metamorphic rock material, and can include hard pan, tree roots and other matter resistant to conventional bits, hard alluvial stones such as 14 within unconsolidated soil 10, and other matter tending to impede conventional drilling operations.

As shown in FIG. 1, a portable handling facility or base such as drilling rig 18 is positioned at the desired local site and is engaged with drill 20 for creating shot hole 22 within the mixed geologic conditions underlying the surface. Shot hole 22 typically comprises a relatively slender hole drilled into the geologic conditions to permit the placement of an explosive charge (not shown) below the surface elevation. Shot hole 22 has a longitudinal axis defining a shot hole path generally extending downwardly into the mixed geologic conditions. Rig 18 is portable and can be moved by truck, boat, helicopter, or by manpower to the selected location.

Drill 20 includes power source 24 engaged with drill stem 26. Drill bit 28 is located on the lower end of drill stem 26 and can include teeth 30 for downward cutting action and hard facing 32 for maintaining the gauge of shot hole 22. Drill 20 can be rotatable or reciprocating and can comprise a diamond type, rotary cone, or other form of drill bit known in the art.

Gun barrel 34 is attached within the hollow interior of drill stem 26 with supports 36, and generally comprises a cylindrical member having discharge end 38 for guiding an explosive projectile 40 into contact with hard rock 12. Magazine 42 contains multiple explosive projectiles 40 and can selectively release each explosive projectile 40 into gun barrel 34. In one embodiment of the invention, a compressed air source such as compressor 44 provides compressed air through feed line 46, and valve 48 selectively releases each explosive projectile 40 into contact with hard rock 12. The compressed air can provide the motive force to accelerate each explosive projectile 40 through gun barrel 34, or such movement can be provided with chemical propellants or with mechanical launching devices. As defined herein, the term "explosive projectile" means any object capable of acceleration through gun barrel 34 and into contact with hard rock 12.

Explosive projectile 40 contacts hard rock 12 and fractures, vibrates, pulverizes or otherwise disturbs hard rock 12. Depending on the disturbing power of explosive projectile 40 and the type of drill 20 in use, explosive projectile 40 can provide substantially the entire energy necessary to remove hard rock 12 from the shot hole 22 path, or can cooperate with drill 20 to increase the drilling efficiency of drill 20 and of drill bit 28. Depending on the structure and composition of the particular hard rock 12 encountered along the shot hole path, explosive projectile 40 might pulverize hard rock 12 to generate shot hole residue. In alternative locations and applications, the application of explosive projectile 40 may be to vibrate or to create microfractures within hard rock 12 to increase the penetrating effectiveness of drill bit 28.

Figure 2:
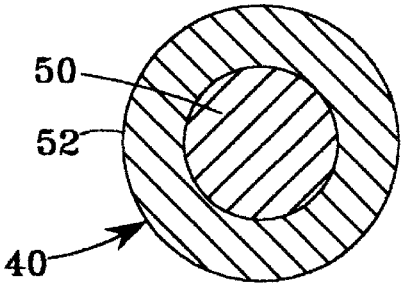
FIG. 2 illustrates one embodiment of an explosive projectile.

Explosive projectile 40 is defined to include any matter which can be accelerated through gun barrel 34 to contact hard rock 12, and to increase the penetration of shot hole 22 through hard rock 12. In a preferred embodiment of the invention as shown in FIG. 2, explosive projectile 40 includes a secondary explosive 50, encapsulated within case 52, which detonates under pressure or impact. This embodiment is useful because secondary explosives are relatively safe to transport and to handle, and can be moved into magazine 42 with minimal risk of premature detonation. Secondary explosive 50 within explosive projectile 40 detonates upon contact with hard rock 12 to generate a shock wave for pulverizing, fracturing or otherwise disturbing hard rock 12.

FIG. 2 illustrates secondary explosive 50 as being completely encapsulated within case 52, however, secondary explosive 50 can be formed on one end of case 52 in other embodiments. The material forming case 52 can be selected to accomplish different objectives. In one embodiment, case 52 can be formed with ceramics which fracture into small fragments and are easily removed from shot hole 22. Case 52 can comprise metallic, organic, or chemical materials and compounds and can be selected depending on cost, mass and performance characteristics, and on the form of residual material after detonation of secondary explosive 50.

FIG. 1 shows residue 54 at the lower end of shot hole 22 which is formed from the combination of pulverized or fragmented unconsolidated 10, hard rock 12, and the residual material from explosive projectiles 40. Residue 54 is removable from shot hole 22 through various means which can comprise mechanical, pneumatic, or chemical devices. In a preferred embodiment of the invention, the means for removing residue 54 can comprise compressed air furnished by compressor 44 through the hollow interior core of drill stem 26. The compressed air can displace residue 54 from the bottom of shot hole 22 and can transport residue 54 upwardly through the annulus between drill stem 26 and shot hole 22. Compressor 44 can provide a high pressure source of compressed air to accelerate explosive projectiles 40, and can provide a relatively low pressure supply of compressed air sufficient to transport residue 54 from shot hole 22. By removing residue 54 from the bottom of shot hole on a continuous or regular basis, the energy from the next explosive projectile 40 is not dissipated into residue 54 which has accumulated on the bottom of shot hole 22.

Controller 56 is engaged with barrel 34 to perform several functions. First, controller 56 can determine whether drill bit 28 is contacting unconsolidated soil 10 or hard rock 12. This determination can be made by monitoring the rate of drill bit 28 penetration. Alternatively, the detection of contact between drill bit 28 and hard rock 12 can be made by other techniques known in the art. When drill bit 28 is engaged with unconsolidated soil 10, the rate of penetration to create shot hole 22 will be relatively great, and compressor 44 will provide compressed air to remove cuttings and other residue from shot hole 22. When hard rock 12 is encountered and the penetration rate decreases, controller 56 activates gun barrel 34 to direct an explosive projectile 40 into contact with hard rock 12. During this time, drill stem 26 can be rotated or reciprocated in a preferred embodiment of the invention to continue the cutting and gauge reaming action of drill bit 28. Compressor 44 continues to remove residue 54 so that a relatively clean surface of shot hole 22 is created to receive contact from a subsequent explosive projectile 40. Additional explosive projectiles 40 can be contacted against hard rock 12 until the desired depth of shot hole 22 is achieved, or until hard rock 12 is penetrated.

The invention uniquely identifies when hard rock 12 is penetrated so that precise control of explosive projectiles 40 can be limited to hard rock 12 applications. If explosive projectiles 40 were used against unconsolidated soil 10, the gauge of the corresponding shot hole section would not be controlled, and over-excavation of unconsolidated soil 10 would lead to an irregularly shaped, unstable shot hole 22. After a hard rock section of the shot hole path has been excavated with explosive projectiles 40, controller 56 identifies such event and ceases the release of explosive projectiles 40. Additional drilling with drill 20 can continue until another obstacle requiring explosive projectiles 40 is encountered, or until shot hole 22 reaches the desired depth.

Figure 3:
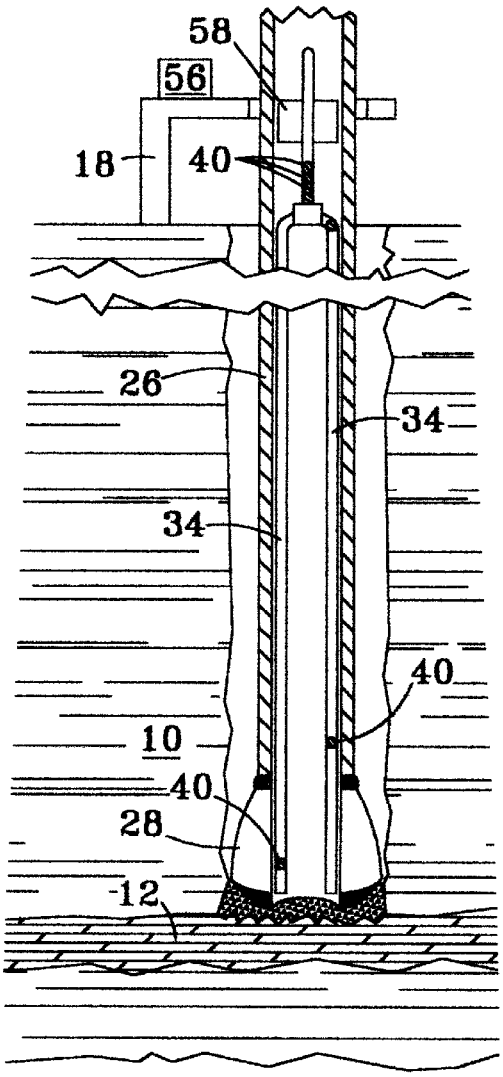
FIG. 3 illustrates an embodiment of the invention having multiple shot barrels.

FIG. 3 illustrates an embodiment of the invention wherein multiple gun barrels 34 are positioned within drill stem 26 to contact hard rock 12 in a selected pattern. If desired, gun barrels 34 can direct explosive projectiles 40 into contact with the perimeter of a planar surface on hard rock 12. In this embodiment of the invention, the operation of drill bit 28 fractures the internal section of hard rock 12 bounded by such planar surface perimeter. In another embodiment of the invention, rotating device 58 can move a single gun barrel 34, or can move multiple gun barrels 34, to vary the contact location between explosive projectiles 40 and hard rock 12. The operation of rotating device 58 can be managed by controller 56.

Figure 4:
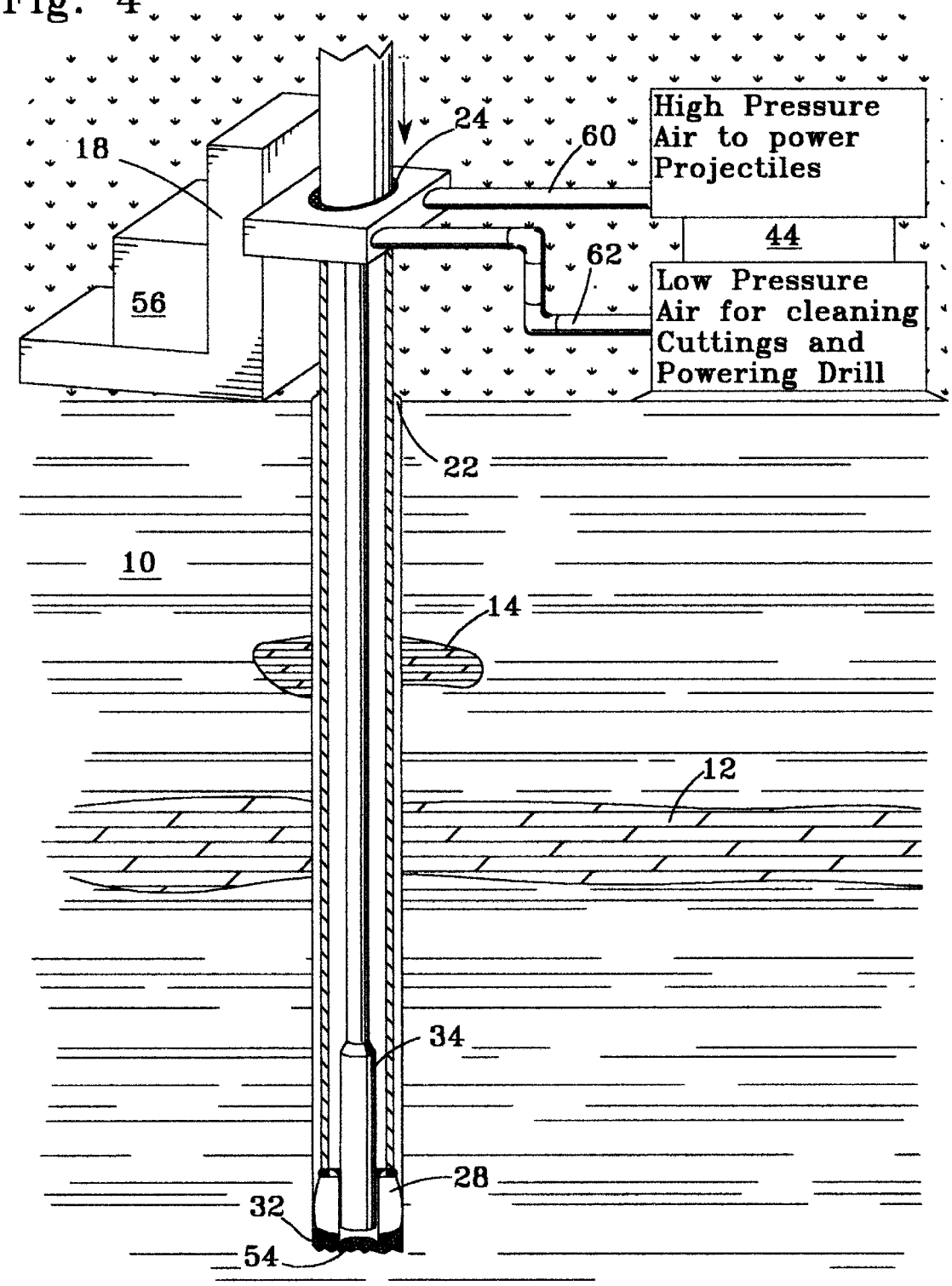
FIG. 4 illustrates an elevational view of the invention using low and high pressure compressed air sources for the acceleration of explosive projectiles and for the removal of residue from the shot path.

FIG. 4 illustrates an elevation view of the invention wherein compressor provides high pressure compressed air through line 60 to accelerate explosive projectiles 40, and provides low pressure compressed air through line 62 to remove residue 54 from shot hole 22 and to operate power source 24. As illustrated in FIG. 4, drill bit 28 has penetrated unconsolidated soil 10 and stone 14 in the path of shot hole 22. Stone 14 was penetrated by utilizing explosive projectiles 40 as previously described, and by discontinuing the discharge of explosive projectiles 40 after stone 14 was penetrated. Hard rock 12 was similarly breached with explosive projectiles 40, and the release of explosive projectiles 40 was discontinued after drill bit 28 penetrated into unconsolidated soil 10 below hard rock 12. By operating controller 56, explosive projectiles 40 selectively excavate the shot hole 22 path through hard rock 12 and similar obstructions such as stone 14.

The invention uniquely provides a compact, portable drilling system capable of creating a shot hole in mixed geologic conditions including unconsolidated soil and hard rock materials. The invention adapts to each subterranean condition by providing a controller which detects the soil condition and selectively controls the application or cessation of explosive projectiles. The automatic actions of the controller can be manually overridden by the drill operator. The motive force for accelerating explosive projectiles and for removing residue from the bottom of the shot hole can be accomplished with compressed air readily generated in remote locations. This feature of the invention is particularly useful in arid locations inaccessible to water supplies.

The invention is particularly useful in creating a slender, straight shot hole that does not deviate from the desired orientation, and which facilitates identification of the downhole location. The invention is particularly useful in mixed geologic conditions where a single granite stone in an alluvial sediment could deflect a conventional drill bit and the shot hole away from a straight, vertical path. The unique capabilities of explosive projectiles combined with a rotating or reciprocating drill bit accelerates shot hole drilling by eliminating the need to trip out of the hole when an obstacle is encountered, and to re-enter with a hard rock drill bit.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

I claim:

1. A portable system for generating a shot hole in mixed geologic conditions of unconsolidated soils and hard rock, comprising:

a portable base;

a drill for creating a shot hole in the unconsolidated soil and for maintaining shot hole gauge through mixed geology conditions;

an explosive projectile for impacting hard rock in the shot hole path to generate shot hole residue;

a shot barrel engaged with said drill for directing said explosive projectile against the hard rock at a velocity sufficient to detonate said explosive projectile; and a compressed air source for removing said shot hole residue from the shot hole.

2. A system as recited in claim 1, wherein said compressed air source generates compressed air for delivering said compressed air to the shot hole to displace said shot hole residue from the shot hole.

3. A system as recited in claim 1, wherein said drill comprises a rotary drill having an exterior surface for contacting the shot hole and for maintaining gauge of the shot hole through the unconsolidated soil and through the hard rock.

4. A system as recited in claim 1, wherein said explosive projectile comprises a ceramic shell and an explosive material.

5. A system as recited in claim 4, wherein said explosive material comprises a secondary explosive.

6. A system as recited in claim 1, wherein said shot barrel is moveable relative to said drill to vary the impact location of said explosive projectile relative to the shot hole.

7. A system as recited in claim 1, further comprising at least two shot barrels positioned to direct explosive projectiles against the hard rock.

8. A system as recited in claim 7, wherein said shot barrels are positioned to impact the hard rock in a selected orientation relative to the shot hole.

9. A system as recited in claim 1, wherein said shot barrel includes a compressed air mechanism for accelerating said explosive projectile against the hard rock.

10. A system as recited in claim 1, further comprising a controller engaged with said shot barrel for selectively controlling the movement of explosive projectiles.

11. A system as recited in claim 10, wherein said controller provides explosive projectile deployment when said drill contacts hard rock, and said controller ceases explosive projectile deployment when said drill contacts unconsolidated soils below the hard rock.

12. A portable system for generating a shot hole in mixed geologic conditions of unconsolidated soils and hard rock, comprising:

a portable base;

a rotatable drill for creating a shot hole in the unconsolidated soil and for maintaining the shot hole gauge through mixed geology conditions;

a plurality of explosive projectiles for impacting hard rock in the shot hole path to generate shot hole residue, wherein each projectile comprises a secondary explosive material and a projectile case;

at least two shot barrels engaged with said drill for directing said explosive projectiles against the hard rock at a velocity sufficient to detonate said explosive projectiles; and a compressed air source for accelerating said explosive projectiles against the hard rock and for removing the shot hole residue from the shot hole.

13. A portable system as recited in claim 12, wherein said explosive projectile case is formed with a material having a hardness less than the hardness of the hard rock.

14. A portable system as recited in claim 12, wherein said explosive projectile case is formed with a ceramic.

15. A portable system as recited in claim 12, further comprising a mechanism for moving said shot barrels to modify the orientation of contact between said explosive projectiles and the hard rock.

16. A portable system as recited in claim 12, further comprising a controller engaged with said shot barrels for selectively controlling the movement of explosive projectiles through said shot barrels.

17. A portable system as recited in claim 16, wherein said controller sequentially controls said compressed air source to substantially remove shot hole residue from the shot hole before each explosive projectile contacts the hard rock.

18. A portable system as recited in claim 16 wherein said controller controls the rate of explosive projectiles accelerated through said shot barrels.

19. A portable system as recited in claim 16, wherein said controller detects contact between said rotatable drill and hard rock and initiates the deployment of explosive projectiles against the hard rock.

20. A portable system as recited in claim 19, wherein said controller detects contact between said rotatable drill and unconsolidated soil below hard rock and ceases the deployment of said explosive projectiles through said barrels.

* * * * *